US012715645B2

(12) United States Patent
Jafri et al.

(10) Patent No.: US 12,715,645 B2
(45) Date of Patent: Aug. 25, 2026

(54) COLLAPSIBLE BOTTLE

(71) Applicant: BABYGAMI CO., Morton Grove, IL (US)

(72) Inventors: Sana Jafri, Skokie, IL (US); Qudsia Khan, Burr Ridge, IL (US)

(73) Assignee: BABYGAMI CO., Morton Grove, IL (US)

( * ) Notice: Subject to any disclaimer, the term of this patent is extended or adjusted under 35 U.S.C. 154(b) by 0 days.

(21) Appl. No.: 18/316,104

(22) Filed: May 11, 2023

(65) Prior Publication Data

US 2024/0375815 A1 Nov. 14, 2024

(51) Int. Cl.
*B65D 1/02* (2006.01)
*B65D 23/00* (2006.01)
*B65D 43/02* (2006.01)

(52) U.S. Cl.
CPC ..... *B65D 1/0292* (2013.01); *B65D 1/0246* (2013.01); *B65D 1/0276* (2013.01); *B65D 23/003* (2013.01); *B65D 43/0202* (2013.01); *B65D 2543/00092* (2013.01); *B65D 2543/00351* (2013.01); *B65D 2543/00435* (2013.01)

(58) Field of Classification Search
CPC ..... B65D 1/0292; B65D 11/18; B65D 11/24
USPC ..... 220/666; 215/11.6
See application file for complete search history.

(56) References Cited

U.S. PATENT DOCUMENTS

| | | | | |
|---|---|---|---|---|
| 4,492,313 | A | 1/1985 | Touzani | |
| RE32,379 | E | 3/1987 | Touzani | |
| D340,413 | S | 10/1993 | Emig | |
| 5,269,426 | A * | 12/1993 | Morano | A61J 11/008 220/784 |
| D401,344 | S | 11/1998 | Bonds | |
| D405,531 | S | 2/1999 | Bonds | |
| D449,381 | S | 10/2001 | de Begon de Larouziere | |
| 7,802,691 | B2 | 9/2010 | Musálek | |
| 7,819,263 | B1 | 10/2010 | DiCarlo-Nelson | |
| 8,763,829 | B2 | 7/2014 | Madaus | |
| 8,915,386 | B2 | 12/2014 | Limwanawong | |
| D777,520 | S | 1/2017 | Singlaub | |
| 2010/0258519 | A1 | 10/2010 | Shelby | |
| 2011/0165298 | A1 | 7/2011 | Hong et al. | |
| 2012/0227860 | A1 * | 9/2012 | Jeremiah | B65D 1/0292 220/666 |
| 2012/0234790 | A1 | 9/2012 | Gollan | |
| 2013/0068717 | A1 | 3/2013 | Hipkins | |
| 2013/0075393 | A1 | 3/2013 | Haynie | |
| 2018/0251254 | A1 | 9/2018 | Groot et al. | |

(Continued)

FOREIGN PATENT DOCUMENTS

WO 2008022605 A1 2/2008

*Primary Examiner* — Jeffrey R Allen

(74) *Attorney, Agent, or Firm* — Benesch Friedlander Coplan & Aronoff LLP

(57) ABSTRACT

According to certain aspects of the present disclosure, a collapsible bottle is provided. The collapsible bottle includes a body. The body includes a shoulder, a base, and a bellows disposed between the shoulder and the base. The bellows section includes a first section, a second section, and a mid section. The first section is disposed between the shoulder and the mid section. The second section is disposed between the mid section and the base. The collapsible bottle includes an annular support ring disposed circumferentially around the mid section of the bellows.

14 Claims, 9 Drawing Sheets

(56) References Cited

U.S. PATENT DOCUMENTS

| | | | | |
|---|---|---|---|---|
| 2018/0327151 | A1 | 11/2018 | Choi et al. | |
| 2018/0370674 | A1 | 12/2018 | Rigardo et al. | |
| 2020/0305619 | A1* | 10/2020 | Tsui ..... | B65D 1/0292 |

* cited by examiner

COLLAPSIBLE BOTTLE

TECHNICAL FIELD

The present disclosure generally relates to bottles, and more specifically relates to collapsible bottles.

BACKGROUND

Many traditional bottles are primarily made of glass or plastic. These traditional glass or plastic bottles maintain their shape and are limited to such shapes because the glass or plastic cannot decrease in volume or size. While these glass and plastic bottles can contain liquid or food, they can be cumbersome and inconvenient to travel with especially after the contents have been consumed. For example, people often take food and drinks with them when traveling, hiking, picnicking, or going on a play date. During the activity, but after consuming the food and drink, they are often troubled with carrying around the empty bottles. Accordingly, there is a desire for bottles that more conveniently addresses space issues when traveling and on adventure activities.

The description provided in the background section should not be assumed to be prior art merely because it is mentioned in or associated with the background section. The background section may include information that describes one or more aspects of the subject technology.

SUMMARY

The present disclosure provides collapsible bottles.

According to certain aspects of the present disclosure, a collapsible bottle is provided. The collapsible bottle includes a body. The body includes a shoulder, a base, and a bellows disposed between the shoulder and the base. The bellows section includes a first section, a second section, and a mid section. The first section is disposed between the shoulder and the mid section. The second section is disposed between the mid section and the base. The collapsible bottle includes an annular support ring disposed circumferentially around the mid section of the bellows.

According to other aspects of the present disclosure, a collapsible bottle is provided. The collapsible bottle includes a body. The body includes a shoulder, a base, and a bellows disposed between the shoulder and the base. The bellows section includes a first section, a second section, and a mid section. The first section is disposed between the shoulder and the mid section. The second section is disposed between the mid section and the base. The first section of the bellows includes a plurality of upper bellows segments. Each upper bellows segment of the plurality of upper bellows segments, moving in a first direction from the shoulder to the mid section, includes a first upper circumference greater than a first subsequent upper circumference of a subsequent adjacent upper bellows segment of the plurality of upper bellows segments. The second section of the bellows includes a plurality of lower bellows segments. Each lower bellows segment of the plurality of lower bellows segments, moving in a second direction from the base to the mid section, includes a second lower circumference greater than a second subsequent lower circumference of a subsequent adjacent lower bellows segment of the plurality of lower bellows segments. The collapsible bottle includes an annular support ring disposed circumferentially around the mid section of the bellows.

According to other aspects of the present disclosure, a collapsible bottle is provided. The collapsible bottle includes a body. The body includes a shoulder, a base, and a bellows disposed between the shoulder and the base. The bellows section includes a first section, a second section, and a mid section. The first section is disposed between the shoulder and the mid section. The second section is disposed between the mid section and the base. The first section of the bellows includes a plurality of upper bellows segments. Each upper bellows segment of the plurality of upper bellows segments, moving in a first upper circumference greater than a first subsequent upper circumference of a subsequent adjacent upper bellows segment of the plurality of upper bellows segments. The second section of the bellows includes a plurality of lower bellows segments. Each lower bellows segment of the plurality of lower bellows segments, moving in a second direction from the base to the mid section, includes a second lower circumference greater than a second subsequent lower circumference of a subsequent adjacent lower bellows segment of the plurality of lower bellows segments. The collapsible bottle includes an annular support ring disposed circumferentially around the mid section of the bellows. The collapsible bottle includes an annular neck coupled to the shoulder. The annular neck includes neck threads disposed around an outer surface of the annular neck. The collapsible bottle includes an interchangeable top including an annular flange. The collapsible bottle includes an annular collar including collar threads disposed around an inner surface of the annular collar. The collar threads of the annular collar are threadably engageable with the neck threads of the annular neck to secure the annular flange of the interchangeable top between the annular neck and the annular collar.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. Accordingly, the drawings and description are to be regarded as illustrative in nature and not restrictive.

Figure 1:
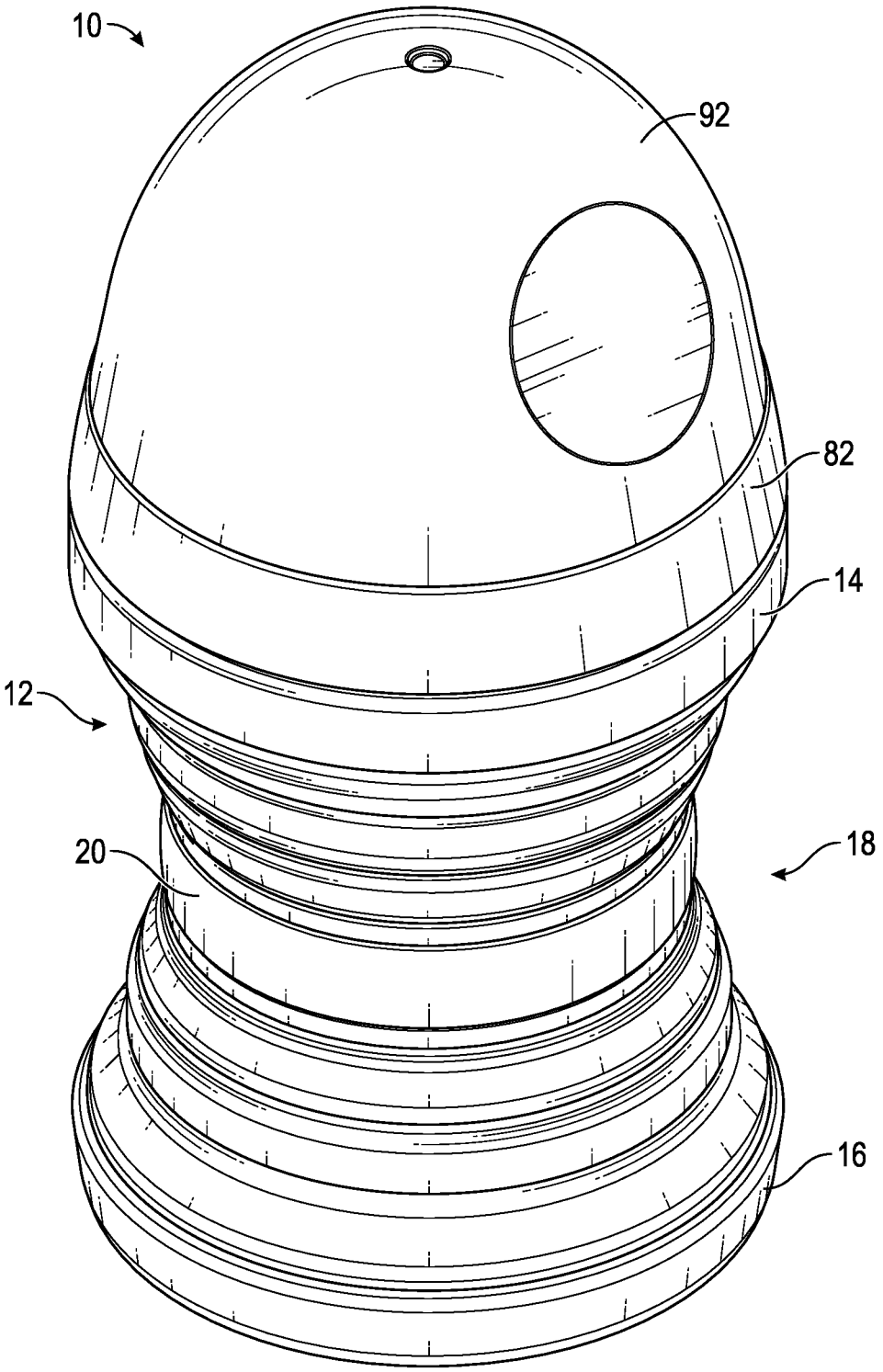
FIG. 1 is a perspective view of a collapsible bottle according to certain aspects of the disclosure.

FIG. 1 illustrates an example collapsible bottle 10. The collapsible bottle 10 is collapsible from an expanded state to a collapsed state and is expandable from the collapsed state to the expanded state, as will be described in more detail below. The collapsible bottle 10 includes a body 12. The body 12 can be formed from, but is not limited to, silicon or other appropriate materials. The body 12 includes a shoulder 14, a base 16, and a bellows 18 disposed between the shoulder 14 and the base 16. The body 12 is substantially hour glass shaped. The collapsible bottle 10 includes an annular support ring 20 that is disposed circumferentially around the body 12. The annular support ring 20 reinforces the body 12 by providing rigidity when using or holding the collapsible bottle 10. In such a manner, when holding the collapsible bottle 10, the annular support ring 20 ensures that contents within the collapsible bottle 10 does not squeeze out.

Figure 2:
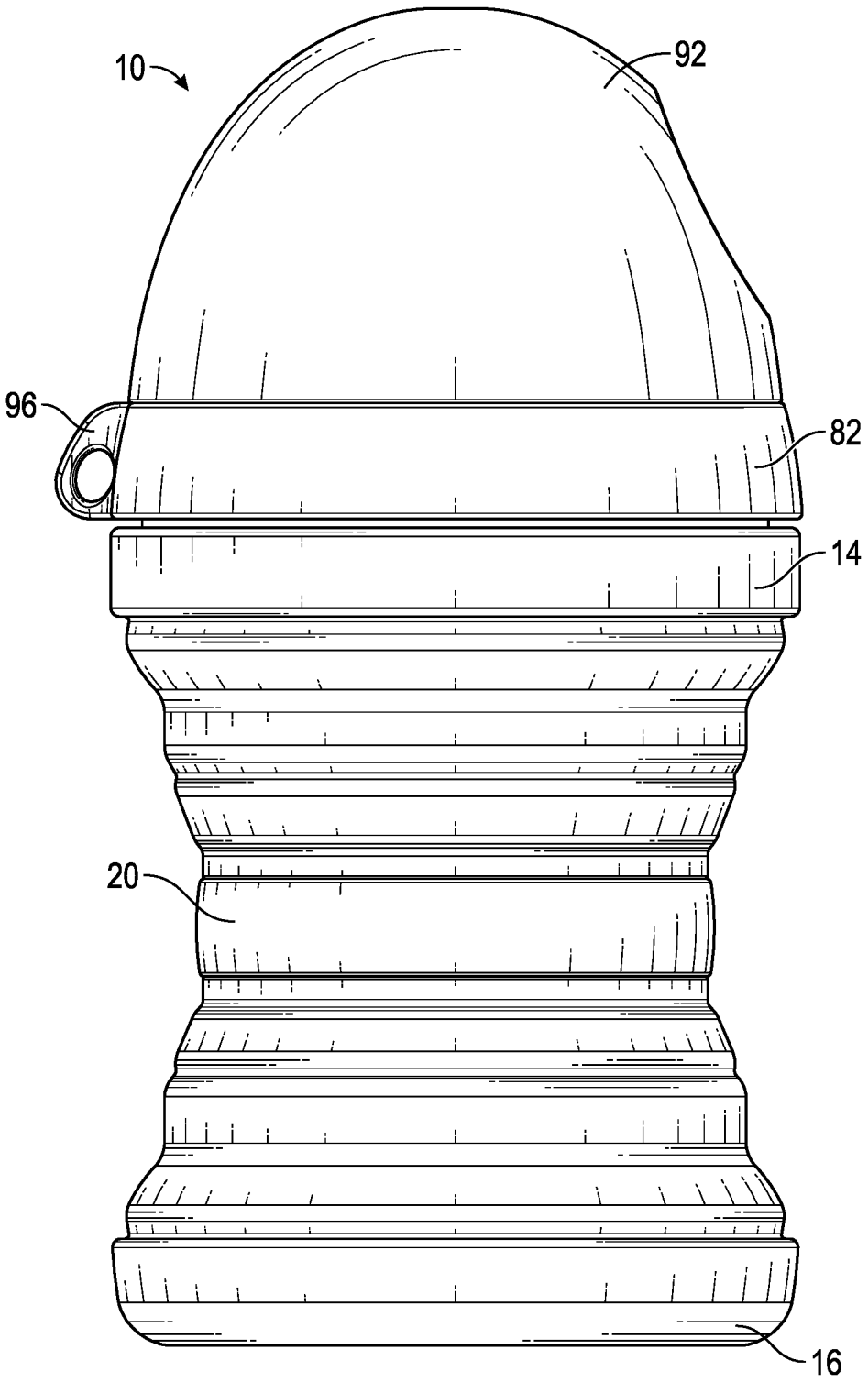
FIG. 2 is a side view of the collapsible bottle of FIG. 1 illustrating the collapsible bottle in an expanded state, according to certain aspects of the disclosure.
Figure 3:
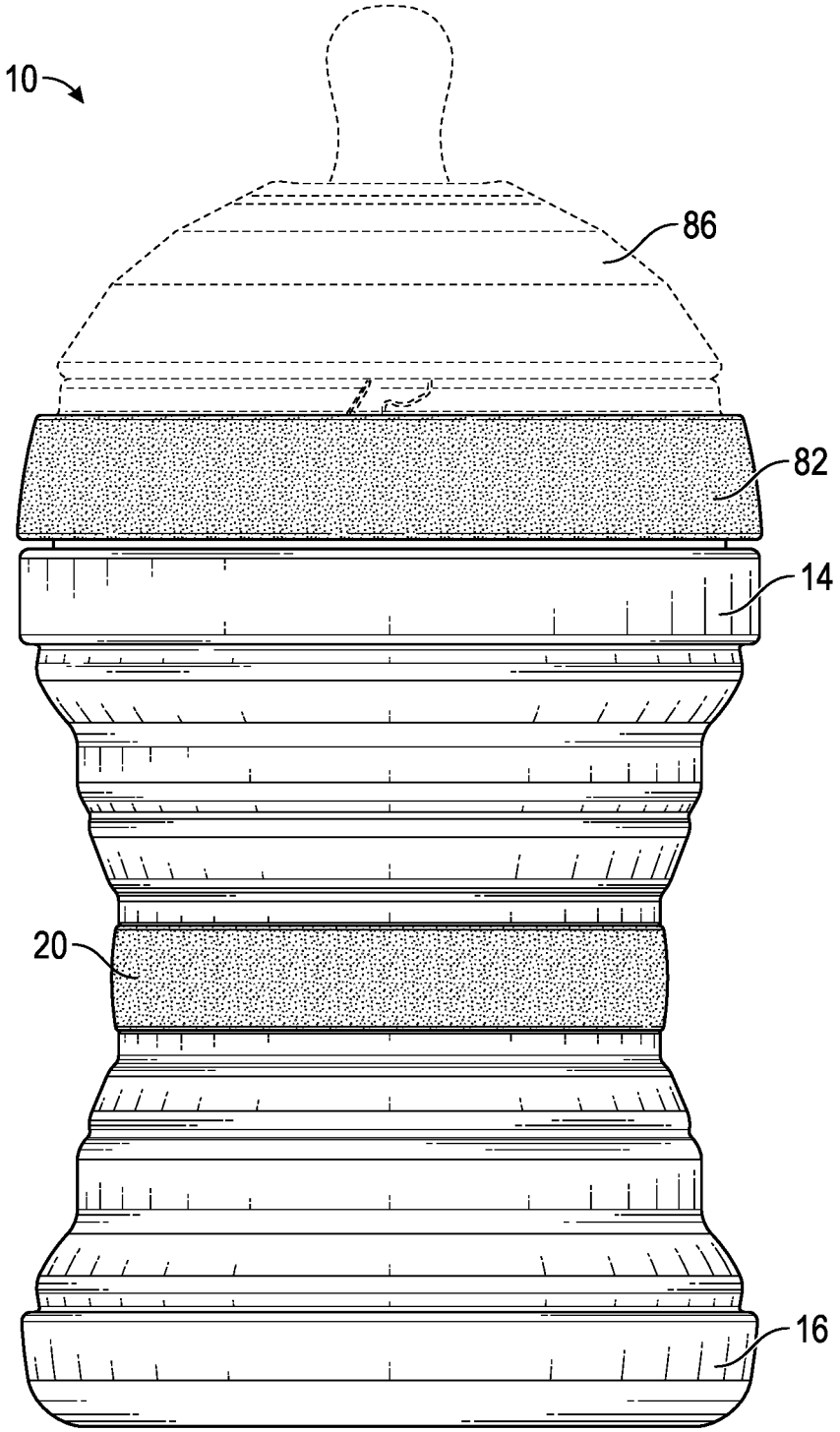
FIG. 3 is a front view of the collapsible bottle of FIG. 1 illustrating a cover removed from the collapsible bottle, according to certain aspects of the disclosure.
Figure 4:
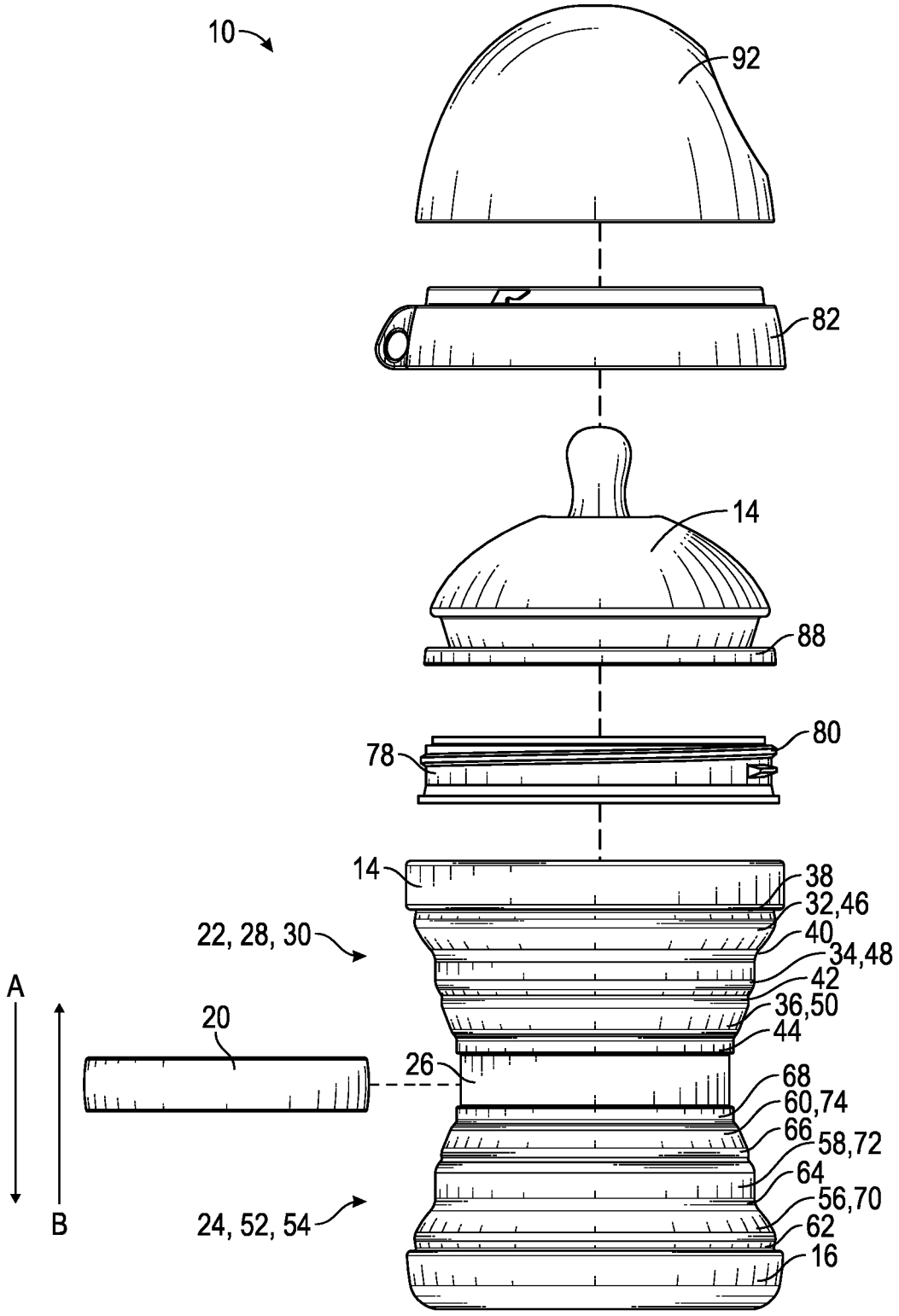
FIG. 4 is an exploded side view of the collapsible bottle of FIG. 1, according to certain aspects of the disclosure.

With reference to FIGS. 1-4, and particular reference to FIG. 4, the bellows 18 includes a first section 22, a second section 24, and a mid section 26. The first section 22 is disposed between the shoulder 14 and the mid section 26. The second section 24 is disposed between the base 16 and the mid section 26. The first section 22 and the second section 24 are substantially mirror images of each other with respect to the mid section 26.

The first section 22 of the bellows 18 includes a plurality of upper bellows segments 28 and a plurality of upper creases 30. For example, in certain aspects, the plurality of upper bellows segments 28 includes a first upper bellows segment 32, a second upper bellows segment 34, and a third upper bellows segment 36. In such aspects, the plurality of upper creases 30 includes a first upper crease 38, a second upper crease 40, a third upper crease 42, and a fourth upper crease 44. It should be understood, however, that the number of upper bellow segments of the plurality of upper bellows segments 28 and the number of upper creases of the plurality of upper creases 30 are not limited by the above exemplarily description and that in other aspects any number of upper bellow segments and upper creases are well within the scope of the present disclosure. The shoulder 14 transitions to the first upper bellows segment 32 via the first upper crease 38. The first upper bellows segment 32 transitions to the second upper bellows segment 34 via the second upper crease 40. The second upper bellows segment 34 transitions to the third upper bellows segment 36 via the third upper crease 42. The third upper bellows segment 36 transitions to the mid section 26 via the fourth upper crease 44.

Moving in a first direction A (see FIG. 4) from the shoulder 14 to the mid section 26, each upper bellows segment of the plurality of upper bellows segments 28 includes a circumference that is greater than a subsequent circumference of a subsequent adjacent upper bellows segment. For example, the first upper bellows segment 32 includes a first upper circumference 46, the second upper bellows segment 34 includes a second upper circumference 48, and the third upper bellows segment 36 includes a third upper circumference 50. The first upper circumference 46 of the first upper bellows segment 32 is greater than the second upper circumference 48 of the second upper bellows segment 34, which is greater than the third upper circumference 50 of the third upper bellows segment 36. This arrangement provides the upper section of the hour glass-like shape of the body 12.

As the first section 22 and the second section 24 of the bellows 18 are mirror images, in a similar manner, the second section 24 of the bellows 18 includes a plurality of lower bellows segments 52 and a plurality of lower creases 54. For example, the plurality of lower bellows segments 52 includes a first lower bellows segment 56, a second lower bellows segment 58, and third lower bellows segment 60. The plurality of lower creases 54 includes a first lower crease 62, a second lower crease 64, a third lower crease 66, and a fourth lower crease 68. It should be understood, however, that the number of lower bellow segments of the plurality of lower bellows segments 52 and the number of lower creases of the plurality of lower creases 54 are not limited by the above exemplarily description and that in other aspects any number of lower bellow segments and lower creases are well within the scope of the present disclosure. The base 16 transitions to the first lower bellows segment 56 via the first lower crease 62. The first lower bellows segment 56 transitions to the second lower bellows segment 58 via the second lower crease 64. The second lower bellows segment 58 transitions to the third lower bellows segment 60 via the third lower crease 66. The third lower bellows segment 60 transitions to the mid section 26 via the fourth lower crease 68. This arrangement provides the lower section of the hour glass-like shape of the body 12.

Moving in a second direction B (see FIG. 4) from the base 16 to the mid section 26, each lower bellows segment of the plurality of lower bellows segments 52 includes a circumference that is greater than a subsequent circumference of a subsequent adjacent lower bellows segment. For example, first lower bellows segment 56 includes a first lower circumference 70, the second lower bellows segment 58 includes a second lower circumference 72, and the third lower bellows segment 60 includes third lower circumference 74. The first lower circumference 70 of the first lower bellows segment 56 is greater than the second lower circumference 72 of the second lower bellows segment 58, which is greater than the third lower circumference 74 of the third lower bellows segment 60.

Because the first section 22 and the second section 24 of the bellows 18 are mirror images, the first upper circumference 46 is equal to the first lower circumference 70, the second upper circumference 48 is equal to the second lower circumference 72, and the third upper circumference 50 is equal to the third lower circumference 74.

The mid section 26 includes a mid section circumference 76. The mid section circumference is less than a subsequent upper circumference of a subsequent adjacent upper bellows segment of the plurality of upper bellows segments 28 that is proximate the mid section 26. Similarly, the mid section circumference 76 is less a subsequent lower circumference of a subsequent adjacent lower bellows segment of the plurality of lower bellows segments 52 that is proximate the mid section 26. For example, the mid section circumference 76 is less than both the third upper circumference 50 of the third upper bellows segment 36 and the third lower circumference 74 of the third lower bellows segment 60.

Figure 8:
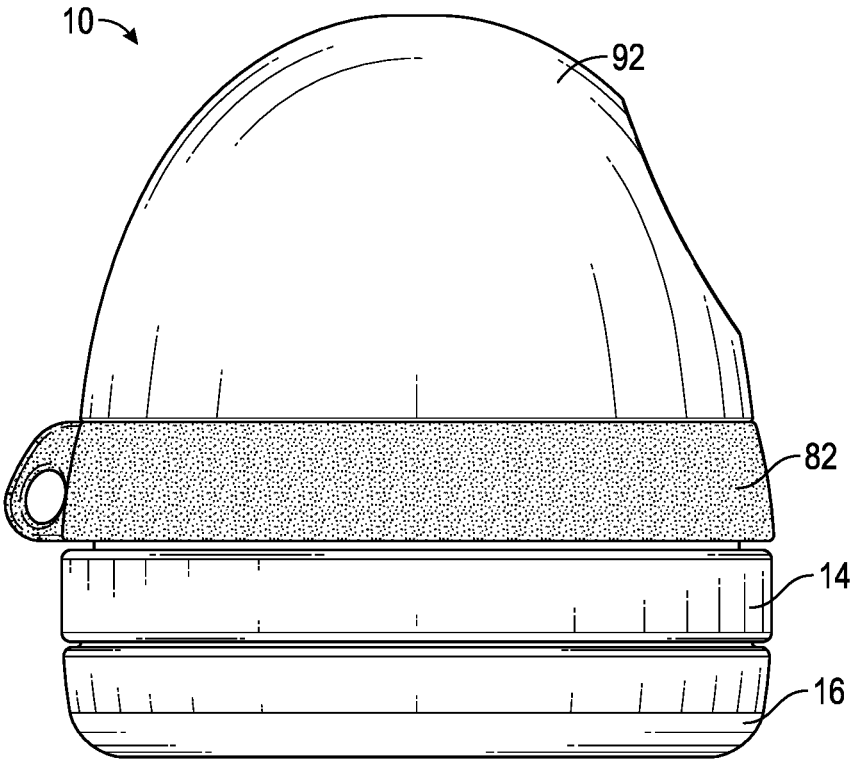
FIG. 8 is a side view of the collapsible bottle of FIG. 1 illustrating the collapsible bottle in a collapsed state, according to certain aspects of the disclosure.
Figure 9:
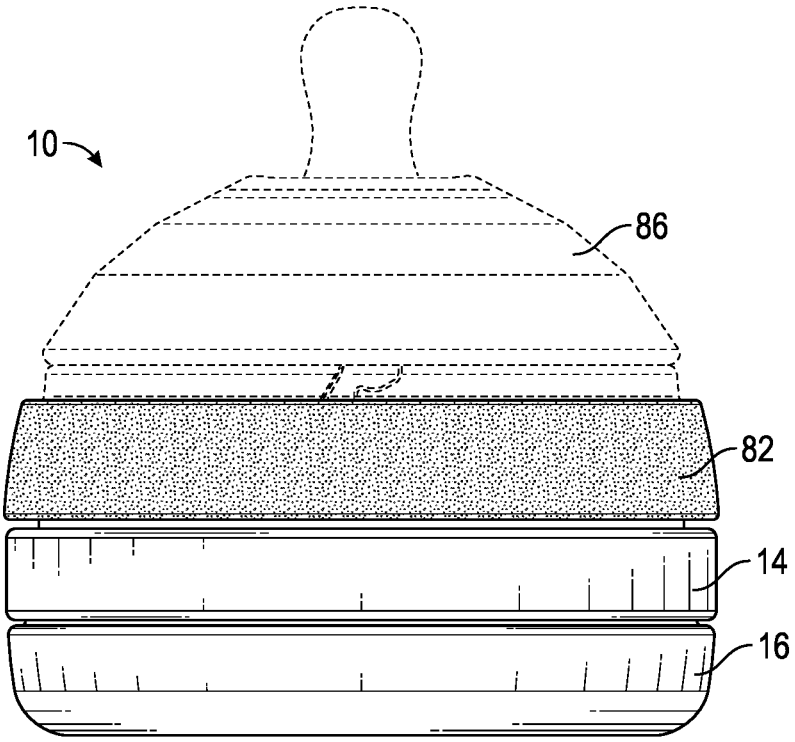
FIG. 9 is a side view of the collapsible bottle of FIG. 1 with the cover removed illustrating the collapsible bottle in a collapsed state, according to certain aspects of the disclosure.
Figure 10:
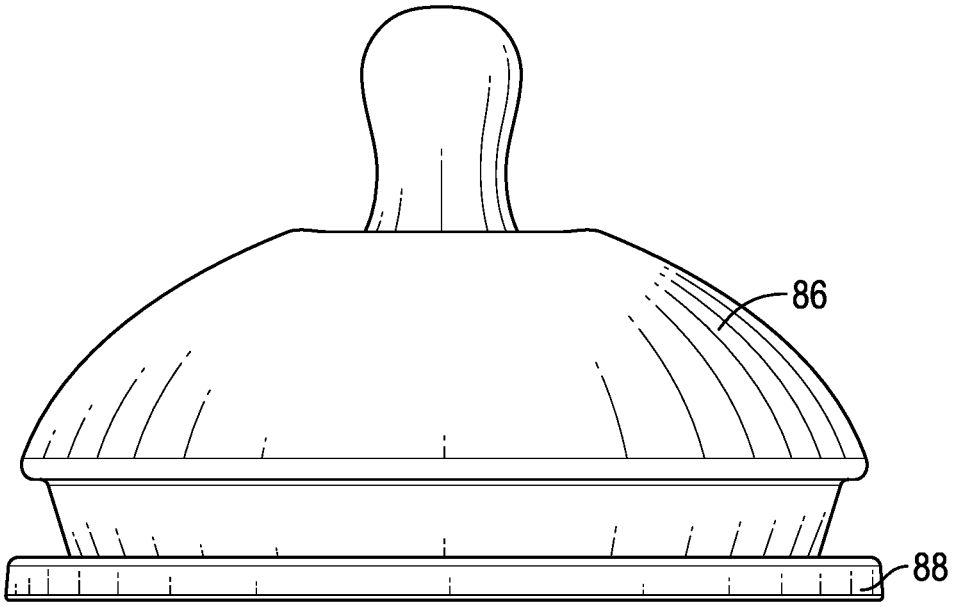
FIG. 10 is a front view of an interchangeable top of the collapsible bottle of FIG. 1, according to certain aspects of the disclosure.

The collapsible bottle 10 can be collapsed from an extended state, as shown in FIGS. 1-3, to a collapsed state, as shown in FIGS. 8 and 9. In the extended state, when pressure is applied to the collapsible bottle 10 in the first direction A, the bellows 18 are compressed until the shoulder 14 and the base 16 adjacent, in the collapsed state. In certain aspects, the volumetric size of the body 12 is reduced by one third when the collapsible bottle 10 is collapsed from the extended state to the collapsed state. In certain aspects, the volumetric size of the body 12 can be, but is not limited to, 6 ounces, 10 ounces, and other appropriate volumetric sizes.

The annular support ring 20 is disposed circumferentially around the mid section 26 of the bellows 18. In certain aspects, the annular support ring 20 is fixedly attached to an exterior surface of the mid section 26 of the bellows 18.

Figure 5:
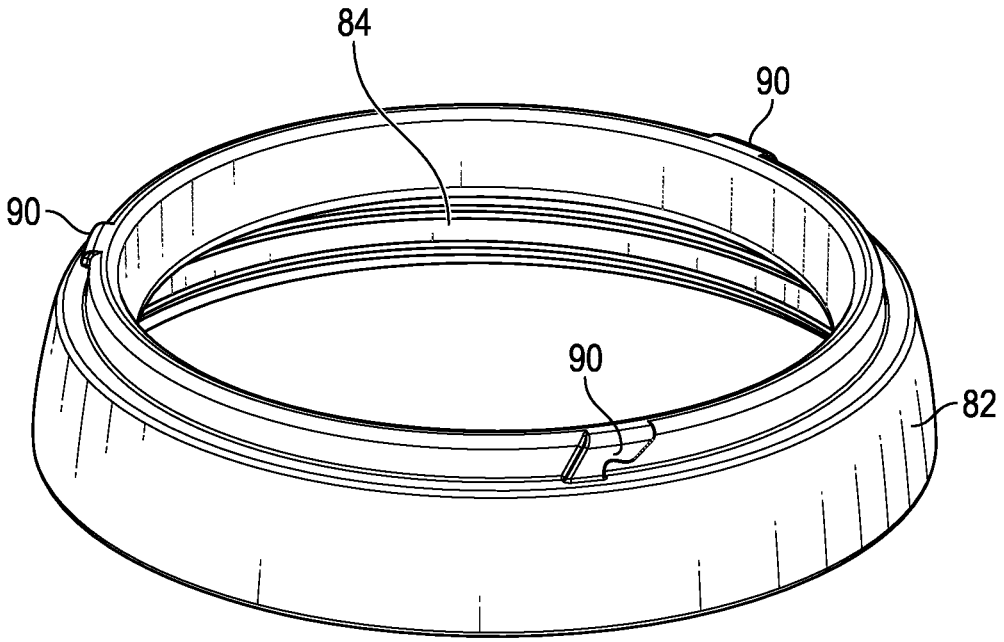
FIG. 5 is a perspective view of an annular collar of the collapsible bottle of FIG. 1, according to certain aspects of the disclosure.
Figure 6:
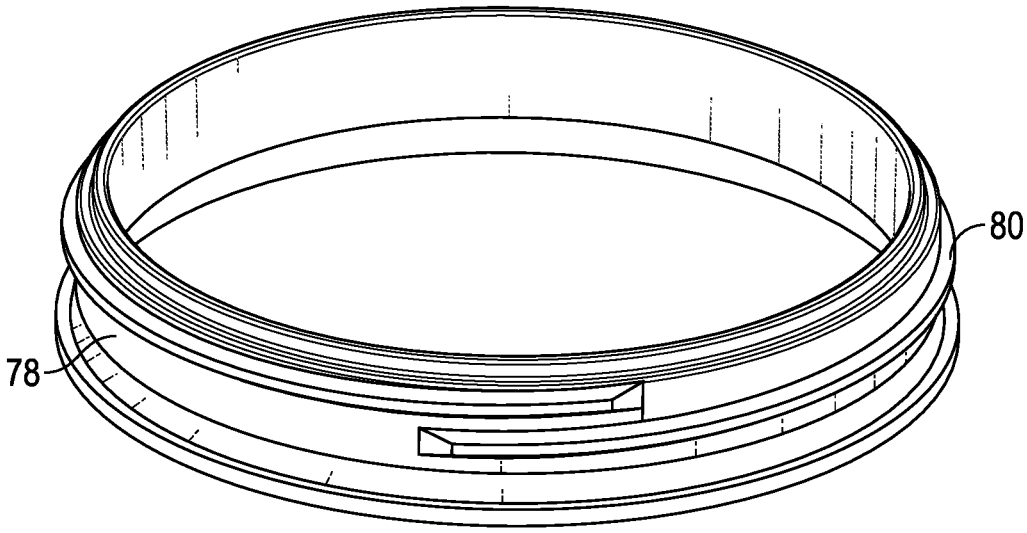
FIG. 6 is a perspective view of an annular neck of the collapsible bottle of FIG. 1, according to certain aspects of the disclosure.

With reference to FIGS. 4 and 6, the collapsible bottle 10 includes an annular neck 78 coupled to the shoulder 14 of the body 12. The annular neck 78 includes neck threads 80 disposed around an exterior surface of the annular neck 78. The collapsible bottle 10 includes an annular collar 82, as illustrated in FIGS. 4 and 5. The annular collar 82 includes collar threads 84 disposed around an interior surface of the annular collar 82.

Figure 11:
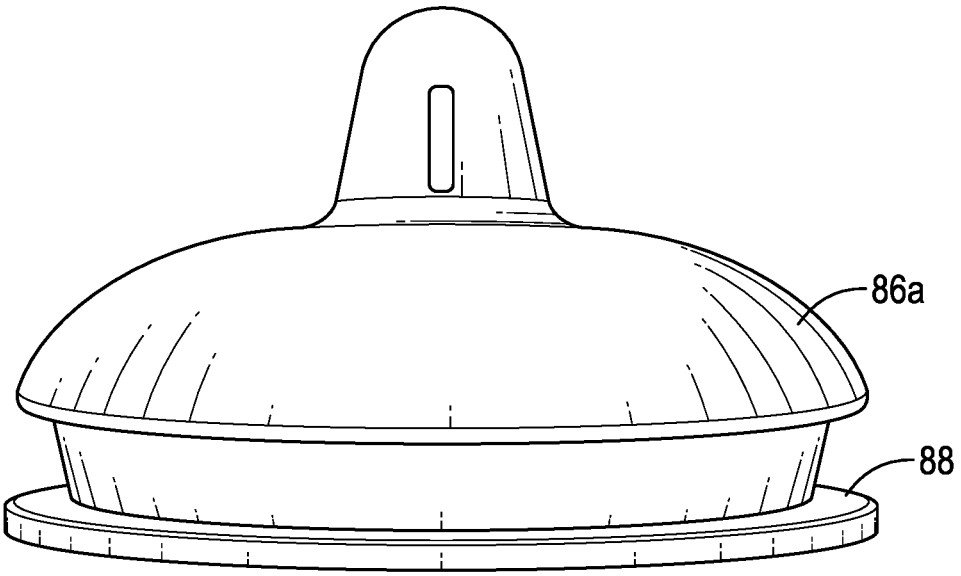
FIG. 11 is a front view of an alternative interchangeable top of the collapsible bottle of FIG. 1, according to certain aspects of the disclosure.
Figure 12:
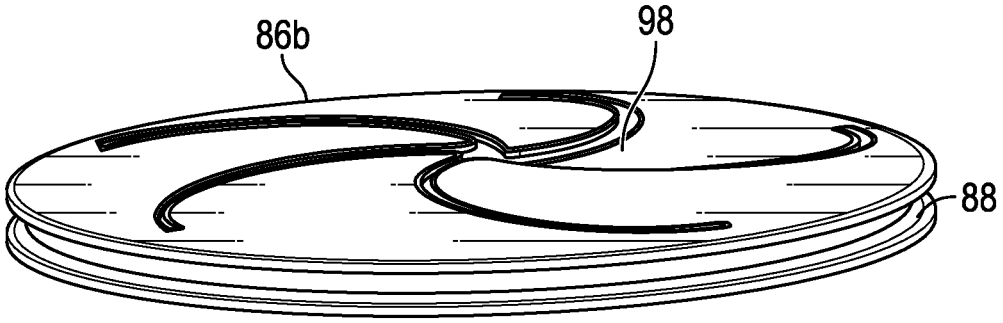
FIG. 12 is a perspective front view of another alternative interchangeable top of the collapsible bottle of FIG. 1, according to certain aspects of the disclosure.

In certain aspects, the collapsible bottle 10 includes an interchangeable top 86. The interchangeable top 86 can be, but is not limited to, a nipple top, a sippy cup top, a lid, and other appropriate tops. As illustrated in FIGS. 3, 4, 9, and 10, the interchangeable top 86 is exemplarily depicted as a nipple top. In certain aspects, the interchangeable top 86 is a sippy cup top 86*a*, as exemplarily illustrated in FIG. 11. In other certain aspects, the interchangeable top 86 is a lid 86*b*, as exemplarily illustrated in FIG. 12. The lid 86*b* includes a plurality of flaps 98, which are configured to flex inwardly, from a closed position to an open position, toward the interior of the body 12 of the collapsible bottle 10 to allow access to contents disposed inside the body 12 and is configured to flex back, from the open position to the closed position, to prevent the contents from escaping from the collapsible bottle 10. The interchangeable top 86 includes an annular flange 88. The interchangeable top 86 can be secured to the body 12 by placing the annular flange 88 proximate the annular neck 78 and placing the annular collar 82 over the interchangeable top 86 such that the annular collar 82 is rotated causing the collar threads 84 of the annular collar 82 to be threadably engaged with the neck threads 80 of the annular neck 78 to secure the annular flange 88 of the interchangeable top 86 between the annular neck 78 and the annular collar 82. The collar threads 84 of the annular collar 82 are threadably engaged with the neck threads 80 of the annular neck 78 in a tight sealing manner to prevent leaks.

Figure 7:
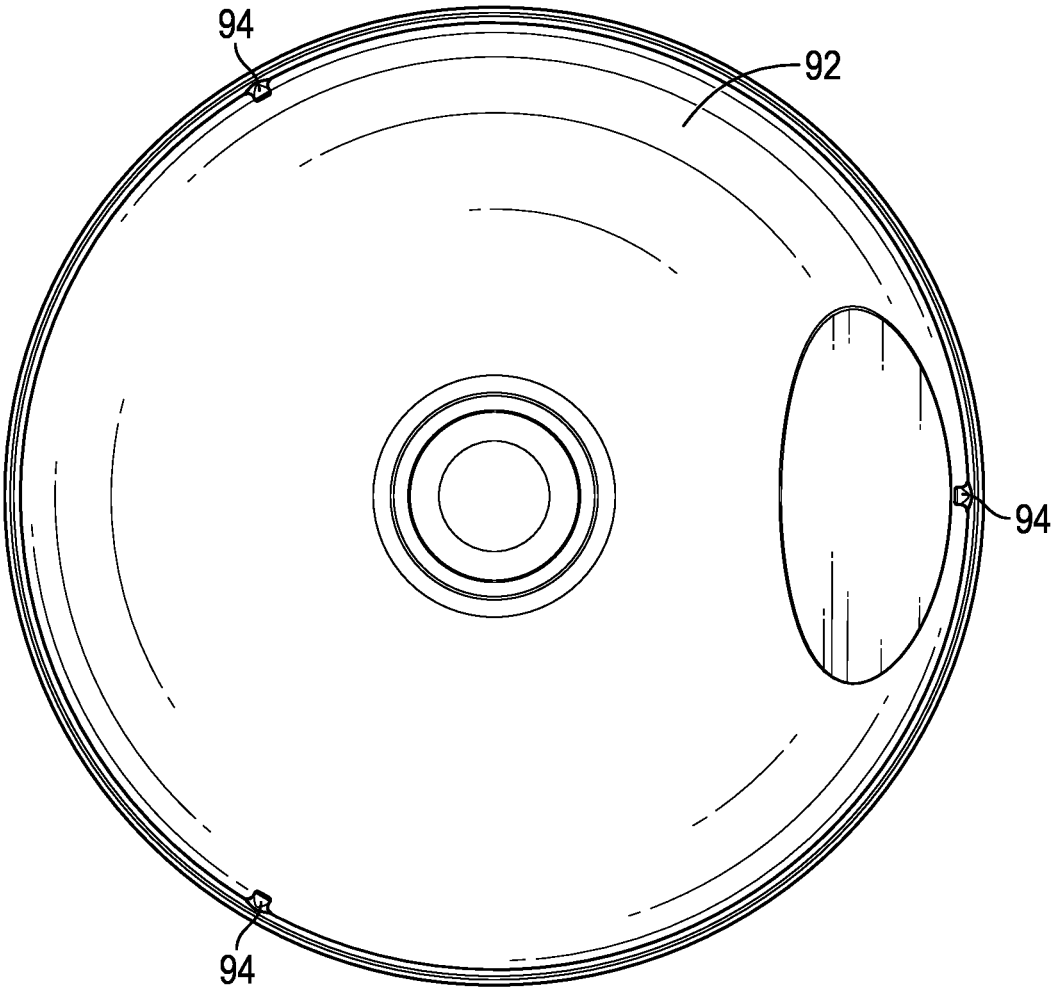
FIG. 7 is a bottom view of the cover of the collapsible bottle of FIG. 1 illustrating a plurality of nubs disposed on an interior surface of the cover, according to certain aspects of the disclosure.

The annular collar 82 includes a plurality of catches 90 disposed around an outer surface of the annular collar 82. In certain aspects, each catch of the plurality of catches 90 is equally spaced apart from each other. The collapsible bottle 10 includes a cover 92. In certain aspects, the cover 92 includes a plurality of nubs 94 disposed on an interior surface of the cover 92, as illustrated in FIG. 7. In certain aspects, each nub of the plurality of nubs 94 is equally spaced apart from each other. The plurality of nubs 94 of the cover 92 are matingly engageable with the plurality of catches 90 of the annular collar 82 to secure the cover 92 to the annular collar 82. In certain aspects, the cover 92 is dome shaped, but other shapes are well within the scope of the present disclosure.

In certain aspects, the annular collar 82 includes an eyelet 96 disposed on the outer surface of the annular collar 82. The eyelet 96 is configured to attach straps or the like for ease of carrying the collapsible bottle 10.

In certain aspects, the base 16 of the body 12 includes a base thickness that is greater than a bellows thickness of the bellows to provide stability and sturdiness when the collapsible bottle 10 is placed on a surface to prevent that the collapsible bottle 10 from tipping over.

The word "exemplary" is used herein to mean "serving as an example, instance, or illustration." Any embodiment described herein as "exemplary" is not necessarily to be construed as preferred or advantageous over other embodiments. Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A reference to an element in the singular is not intended to mean "one and only one" unless specifically stated, but rather "one or more." The term "some" refers to one or more. Relational terms such as first and second and the like may be used to distinguish one entity or action from another without necessarily requiring or implying any actual such relationship or order between such entities or actions. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description. No claim element is to be construed under the provisions of 35 U.S.C. § 112, sixth paragraph, unless the element is expressly recited using the phrase "means for" or, in the case of a method claim, the element is recited using the phrase "step for".

While this specification contains many specifics, these should not be construed as limitations on the scope of what may be claimed, but rather as descriptions of particular implementations of the subject matter. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

The subject matter of this specification has been described in terms of particular aspects, but other aspects can be implemented and are within the scope of the following claims. For example, while operations are depicted in the drawings in a particular order, this should not be understood as requiring that such operations be performed in the particular order shown or in sequential order, or that all illustrated operations be performed, to achieve desirable results. The actions recited in the claims can be performed in a different order and still achieve desirable results. As one example, the processes depicted in the accompanying figures do not necessarily require the particular order shown, or sequential order, to achieve desirable results. In certain circumstances, multitasking and parallel processing may be advantageous.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

What is claimed is:

1. A collapsible bottle comprising:

a body comprising:

a shoulder, a base, and a bellows disposed between the shoulder and the base, wherein the bellows comprises a first section, a second section, and a mid section, the first section disposed between the shoulder and the mid section, the second section disposed between the mid section and the base;

a reinforced annular support ring disposed circumferentially around, and fixedly attached to, an exterior surface of the mid section of the bellows, wherein the reinforced annular support ring is configured to provide rigidity when holding the collapsible bottle to ensure that contents within the collapsible bottle does not squeeze out;

an annular neck coupled to the shoulder of the body, wherein the annular neck comprises neck threads disposed around an outer surface of the annular neck;

an annular collar comprising collar threads disposed around an inner surface of the annular collar, wherein the collar threads of the annular collar are threadably engageable with the neck threads of the annular neck; and an interchangeable top comprising an annular flange, wherein the annular flange of the interchangeable top is securable between the annular neck and the annular collar when the annular flange is placed proximate the annular neck, the annular collar is placed over the interchangeable top, and the collar threads of the annular collar are threadably engaged with the neck threads of the annular neck.

2. The collapsible bottle of claim 1, further comprising:

a cover comprising a plurality of nubs disposed on an interior surface of the cover, wherein the plurality of nubs are matingly engageable with a plurality of catches disposed around an outer surface of the annular collar to secure the cover to the annular collar.

3. The collapsible bottle of claim 1, wherein the interchangeable top is one of a nipple top, a sippy cup top, and a lid.

4. The collapsible bottle of claim 1, wherein the base includes a base thickness that is greater than a bellows thickness of the bellows.

5. The collapsible bottle of claim 1, wherein the body comprises an expanded state and a collapsed state, wherein, in the collapsed state, the bellows are compressed such that the shoulder and the base are adjacent.

6. A collapsible bottle comprising:

a body comprising:

a shoulder, a base, and a bellows disposed between the shoulder and the base, wherein the bellows comprises a first section, a second section, and a mid section, the first section disposed between the shoulder and the mid section, the second section disposed between the mid section and the base, the first section of the bellows comprising a plurality of upper bellows segments, wherein each upper bellows segment of the plurality of upper bellows segments, moving in a first direction from the shoulder to the mid section, comprises a first upper circumference greater than a first subsequent upper circumference of a subsequent adjacent upper bellows segment of the plurality of upper bellows segments, the second section of the bellows comprising a plurality of lower bellows segments, wherein each lower bellows segment of the plurality of lower bellows segments, moving in a second direction from the base to the mid section, comprises a second lower circumference greater than a second subsequent lower circumference of a subsequent adjacent lower bellows segment of the plurality of lower bellows segments;

a reinforced annular support ring disposed circumferentially around, and fixedly attached to, an exterior surface of the mid section of the bellows, wherein the reinforced annular support ring is configured to provide rigidity when holding the collapsible bottle to ensure that contents within the collapsible bottle does not squeeze out;

an annular neck coupled to the shoulder of the body, wherein the annular neck comprises neck threads disposed around an outer surface of the annular neck;

an annular collar comprising collar threads disposed around an inner surface of the annular collar, wherein the collar threads of the annular collar are threadably engageable with the neck threads of the annular neck; and an interchangeable top comprising an annular flange, wherein the annular flange of the interchangeable top is securable between the annular neck and the annular collar when the annular flange is placed proximate the annular neck, the annular collar is placed over the interchangeable top, and the collar threads of the annular collar are threadably engaged with the neck threads of the annular neck.

7. The collapsible bottle of claim 6, wherein the mid section comprises a mid section circumference, wherein the mid section circumference is less than the first subsequent upper circumference of the subsequent adjacent upper bellows segment of the plurality of upper bellows segments proximate the mid section, and the mid section circumference is less the second subsequent lower circumference of the subsequent adjacent lower bellows segment of the plurality of lower bellows segments proximate the mid section.

8. The collapsible bottle of claim 6, further comprising:

a cover comprising a plurality of nubs disposed on an interior surface of the cover, wherein the plurality of nubs are matingly engageable with a plurality of catches disposed around an outer surface of the annular collar to secure the cover to the annular collar.

9. The collapsible bottle of claim 6, wherein the interchangeable top is one of a nipple top, a sippy cup top, and a lid.

10. The collapsible bottle of claim 6, wherein the base includes a base thickness that is greater than a bellows thickness of the bellows.

11. The collapsible bottle of claim 6, wherein the body comprises an expanded state and a collapsed state, wherein, in the collapsed state, the bellows are compressed such that the shoulder and the base are adjacent.

12. A collapsible bottle comprising:

a body comprising:

a shoulder, a base, and a bellows disposed between the shoulder and the base, wherein the bellows comprises a first section, a second section, and a mid section, the first section disposed between the shoulder and the mid section, the second section disposed between the mid section and the base, the first section of the bellows comprising a plurality of upper bellows segments, wherein each upper bellows segment of the plurality of upper bellows segments, moving in a first direction from the shoulder to the mid section, comprises a first upper circumference greater than a first subsequent upper circumference of a subsequent adjacent upper bellows segment of the plurality of bellows segments, the second section of the bellows comprising a plurality of lower bellows segments, wherein each lower bellows segment of the plurality of lower bellows segments, moving in a second direction from the base to the mid section, comprises a second lower circumference greater than a second subsequent lower circumference of a subsequent adjacent lower bellows segment of the plurality of lower bellows segments;

a reinforced annular support ring disposed circumferentially around, and fixedly attached to, an exterior surface of the mid section of the bellows, wherein the reinforced annular support ring is configured to provide rigidity when holding the collapsible bottle to ensure that contents within the collapsible bottle does not squeeze out;

an annular neck coupled to the shoulder, wherein the annular neck comprises neck threads disposed around an outer surface of the annular neck;

an annular collar comprising collar threads disposed around an inner surface of the annular collar, wherein the collar threads of the annular collar are threadably engageable with the neck threads of the annular neck to secure the annular flange of the interchangeable top between the annular neck and the annular collar; and an interchangeable top comprising an annular flange, wherein the annular flange of the interchangeable top is securable between the annular neck and the annular collar when the annular flange is placed proximate the annular neck, the annular collar is placed over the interchangeable top, and the collar threads of the annular collar are threadably engaged with the neck threads of the annular neck.

13. The collapsible bottle of claim 12, wherein the mid section comprises a mid section circumference, wherein the mid section circumference is less than the first subsequent upper circumference of the subsequent adjacent upper bellows segment of the plurality of upper bellows segments proximate the mid section, and the mid section circumference is less the second subsequent lower circumference of the subsequent adjacent lower bellows segment of the plurality of lower bellows segments proximate the mid section.

14. The collapsible bottle of claim 13, wherein the body comprises an expanded state and a collapsed state, wherein, in the collapsed state, the bellows are compressed such that the shoulder and the base are adjacent.

* * * * *